US005605167A

United States Patent [19]

Montoli

[11] Patent Number: 5,605,167

[45] Date of Patent: Feb. 25, 1997

[54] COMPACT WITH REPLACEABLE PRODUCT TRAY

[75] Inventor: Antonio Montoli, Brookfield, Conn.

[73] Assignee: Risdon Corporation, Naugatuck, Conn.

[21] Appl. No.: 510,550

[22] Filed: Aug. 2, 1995

[51] Int. Cl.[6] ..... A45D 33/24; A45D 33/26

[52] U.S. Cl. ..... 132/294; 132/293; 132/314; 132/315

[58] Field of Search ..... 132/293, 294, 132/314, 315; 206/581, 235, 823; 220/410; 211/126

[56] References Cited

U.S. PATENT DOCUMENTS

| | | | |
|---|---|---|---|
| 1,767,567 | 6/1930 | Weil . | |
| 2,628,625 | 2/1953 | Pike | 132/79 |
| 4,008,543 | 2/1977 | Vilt | 211/126 |
| 4,333,573 | 6/1982 | Holoubek | 211/126 |
| 4,421,127 | 12/1983 | Geer | 132/83 |
| 4,826,014 | 5/1989 | Schefer | 206/581 |
| 4,863,034 | 9/1989 | Contreras, Sr. | 206/581 |
| 5,005,697 | 4/1991 | Jimbo et al. | 206/235 |
| 5,025,817 | 6/1991 | Wen | 132/294 |
| 5,092,354 | 3/1992 | Pacelli, Jr. | 132/294 |
| 5,199,451 | 4/1993 | Montoli | 132/315 |
| 5,320,116 | 6/1994 | Ackermann | 132/293 |
| 5,353,947 | 10/1994 | Zinnbauer et al. | 206/581 |
| 5,373,862 | 12/1994 | Blachut | 132/294 |
| 5,375,734 | 12/1994 | Tiramani | 206/581 |
| 5,379,901 | 1/1995 | Blachut | 206/581 |

OTHER PUBLICATIONS

Lego blocks, as described in the attached printout from WWW.LEGO.com/history/index.html.

*Primary Examiner*—Gene Mancene
*Assistant Examiner*—Pedro Philogene
*Attorney, Agent, or Firm*—St. Onge Steward Johnston & Reens

[57] ABSTRACT

A cosmetic compact permitting easy replacement of product trays, wherein a recess in the compact and the tray have interfitting pluralities of locking elements, specifically, studs and mating elements, that frictionally engage each other to retain the tray in the recess of the compact.

18 Claims, 4 Drawing Sheets

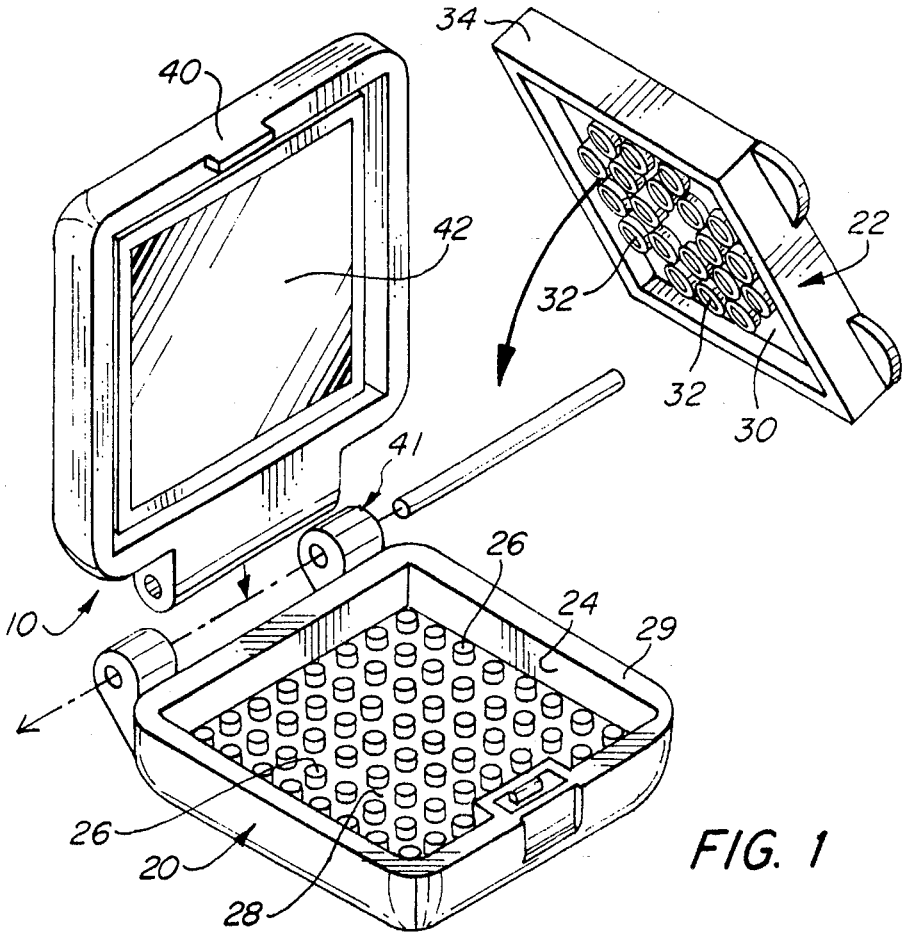
FIG. 1
FIG. 2
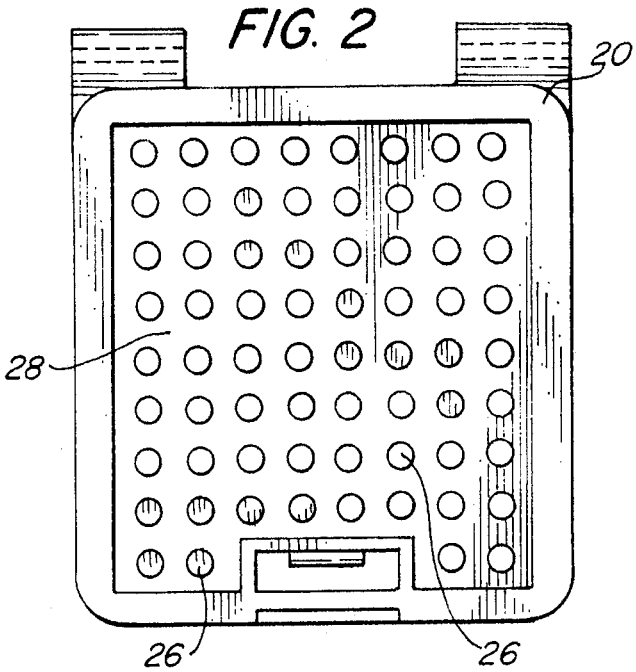
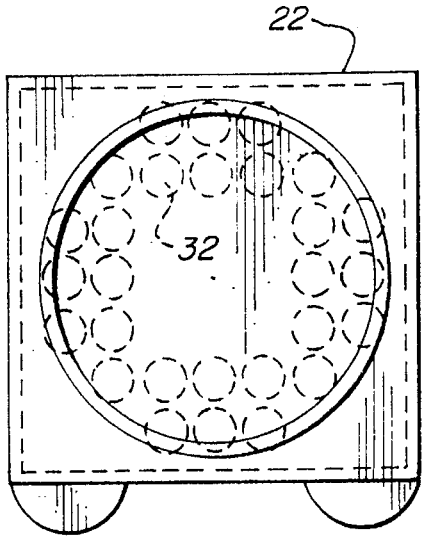
FIG. 3

COMPACT WITH REPLACEABLE PRODUCT TRAY

FIELD OF THE INVENTION

The present invention relates to the field of cosmetic compacts.

BACKGROUND OF THE INVENTION

In recent years there has been a developing interest on the part of consumers, and cosmetics companies, in reusable cosmetic product packaging. This interest reflects an interest in reducing costs, since product cost can be reduced if the decorative outer shell or housing can be reused with a fresh refill of product, as well as an interest in having a more environmentally sound product that has smaller quantities of waste associated with the use of the product.

SUMMARY OF THE INVENTION

It is an object of the invention to provide an improved compact for a cosmetic product in which a consumer can easily replace cosmetic trays.

It is an object of the invention that such cosmetic trays be secure when inserted into the compact.

In accordance with the present invention, a compact for a cosmetic comprises a base, and a removable product tray fittable into a recess in the base. A plurality of regularly spaced apart resilient elements extend from one of: the bottom wall of the recess, and the bottom surface of the tray. A mating plurality of regularly spaced apart studs extends from the other of: the bottom wall of the recess and the bottom surface of the tray. The studs and the resilient elements are molded in the base recess and tray bottom surface in locations relative to each other such that the studs and resilient elements interfit and frictionally engage with each other to hold the tray in the recess. Preferably, the tray further comprises a peripheral downwardly extending skirt around its outer perimeter. In such case, the skirt, and its adjacent resilient elements, or studs, interfit with and frictionally engage the corresponding resilient elements, or studs on the base, respectively. Preferably, the resilient elements are annular in cross-section, and the studs are circular in cross section.

Preferably, the tray further comprises means which is usable by the consumer to remove the tray from the base, when the tray is empty, or if the consumer desires to change to a tray having a different color cosmetic, for example, if a consumer wanted to change from colors considered appropriate for office wear to colors of cosmetics considered appropriate for evening or party wear.

In one embodiment of the compact of the invention there is one such tray; in another embodiment there are two or more such trays. A cover is preferably secured by a hinge to the base.

Other objects, aspects and features of the present invention in addition to those mentioned above will be pointed out in or will be understood from the following detailed description provided in conjunction with the accompanying drawings.

BRIEF DESCRIPTION OF THE DRAWINGS

FIG. 1 is an exploded perspective view of a compact in accordance with one embodiment of the invention.

FIG. 2 is a top plan view of the base of the compact of FIG. 1.

FIG. 3 is a top plan view of the tray of the compact of FIG. 1.

DETAILED DESCRIPTION OF THE PREFERRED EMBODIMENT

Figure 4:
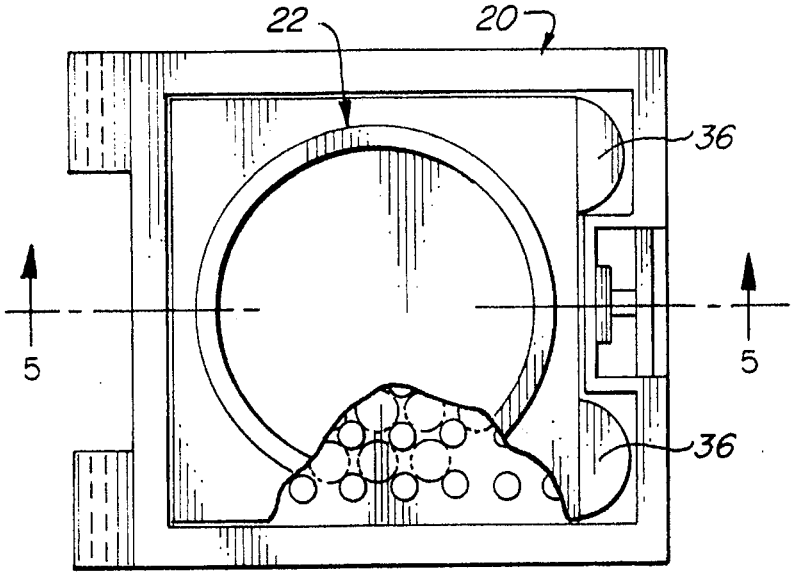
FIG. 4 is a top cutaway view of the compact of FIG. 1.
Figure 5:
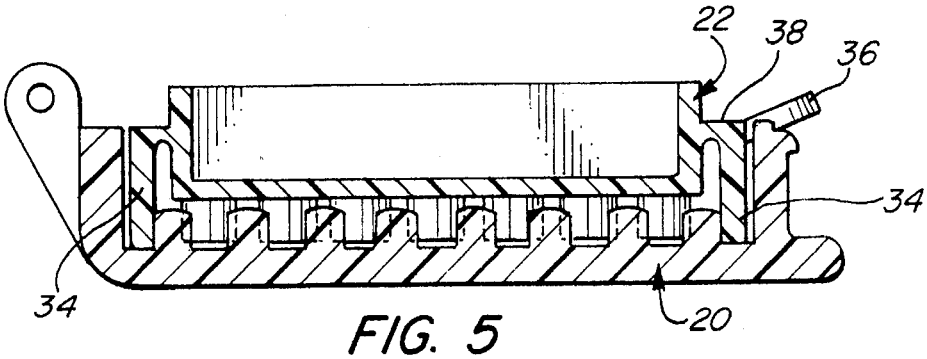
FIG. 5 is a cross-sectional view of the compact of FIG. 4 along the line 5—5.
Figure 6:
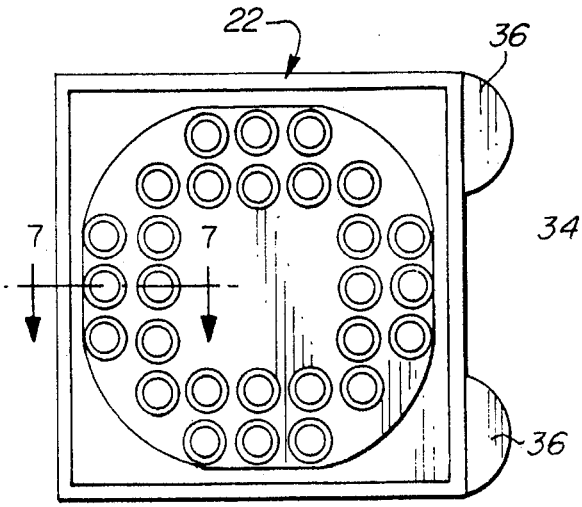
FIG. 6 is a bottom plan view of the tray of FIG. 3.
Figure 7:
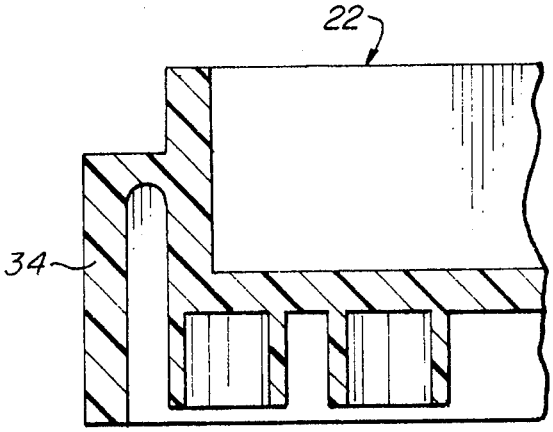
FIG. 7 is a detail cross-sectional view of the tray of FIG. 6 along the line 7—7.
Figure 8:
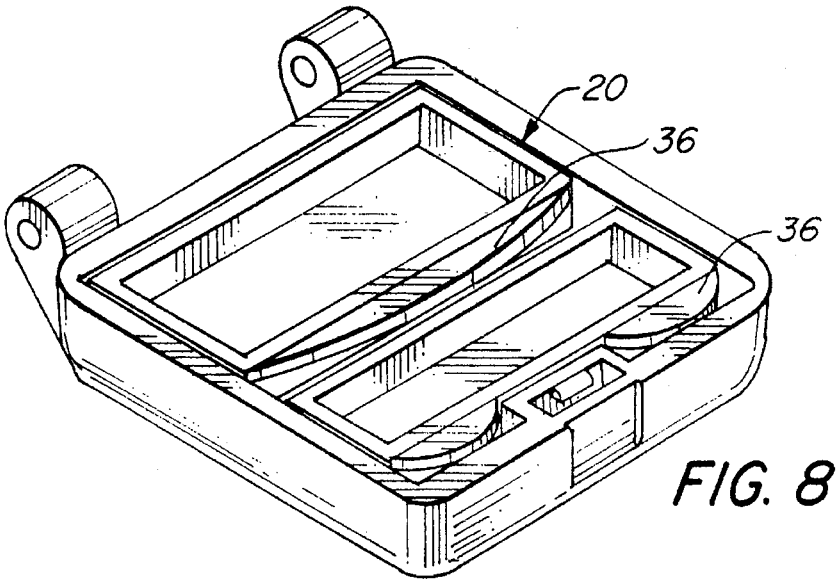
FIG. 8 is a perspective view of a base and tray of a compact in accordance with another embodiment of the invention.
Figure 9:
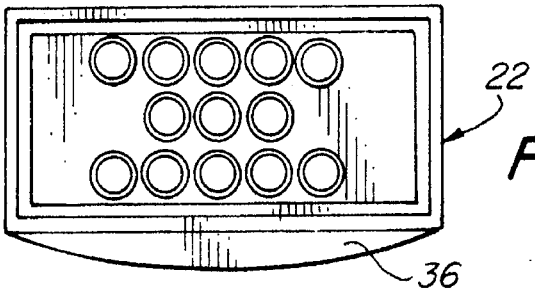
FIG. 9 is a bottom plan view of one tray of the compact of FIG. 8.
Figure 10:
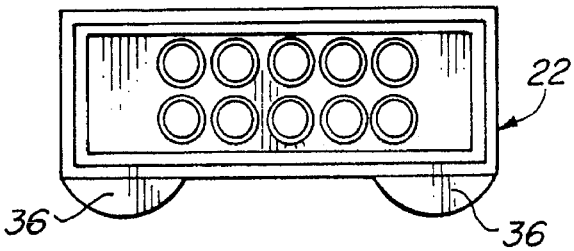
FIG. 10 is a bottom plan view of another tray of the compact of FIG. 8.
Figure 11:
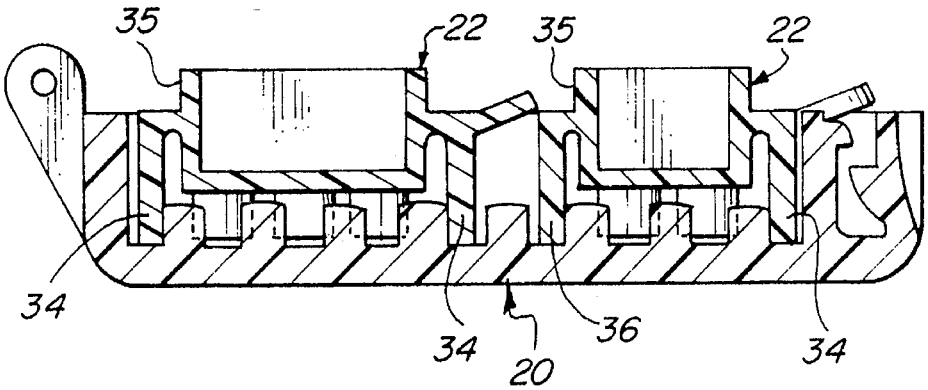
FIG. 11 is a cross-sectional view of the base and tray of the compact of FIG. 8.

Referring now to FIGS. 1–13, where like elements are identified by like numbers in the drawings, an improved compact 10 for a cosmetic, such as powder, blush, or eyeshadow, is shown.

Compact 10 comprises a base 20, and a removable product tray 22. Tray 22 is fittable into a recess 24 in the base 20. Recess 24 has a bottom wall 28 and a peripheral wall 29. In FIGS. 1–11, a plurality of regularly spaced apart studs 26 extend upwardly from the bottom wall 28 of the recess 24. As shown in the drawings, studs 26 are preferably circular in cross-section, however, other cross-sectional shapes may be used, including triangular, square and pentagonal shapes, star shapes and cross shapes, including cross shapes having from three to ten radially outward extending flanges, as well as irregular shapes, and including both solid and hollow shapes. A mating plurality of regularly spaced apart resilient elements 32 extend downwardly from the bottom surface 30 of the tray 22. The studs 26 and the resilient elements 32 are molded in the base recess 24 and tray bottom surface 30, respectively, relative to each other such that the studs 26 and resilient elements 32 interfit and frictionally engage with each other to hold the tray 22 in the recess 24.

As shown in the drawings, resilient elements 32 preferably comprise annular elements or rings, however, like the studs 26, the resilient elements 32 may take a plurality of forms, including triangular, square and pentagonal shapes, star shapes and cross shapes, including cross shapes having from three to ten radially outward extending flanges, as well as irregular shapes, and including both solid and hollow shapes.

The studs 26 provided in the recess 24 in FIGS. 1–11 (and the resilient elements provided in the recess 24 in FIGS. 12–13) can extend over the full surface of the recess 24, or they can be limited to certain select areas of the recess. For example, if it is desirable to provide a well for a cosmetic applicator in front of, or along one side of, the tray 22, the recess will not need the studs or elements in such portion of the recess 24.

Figure 12:
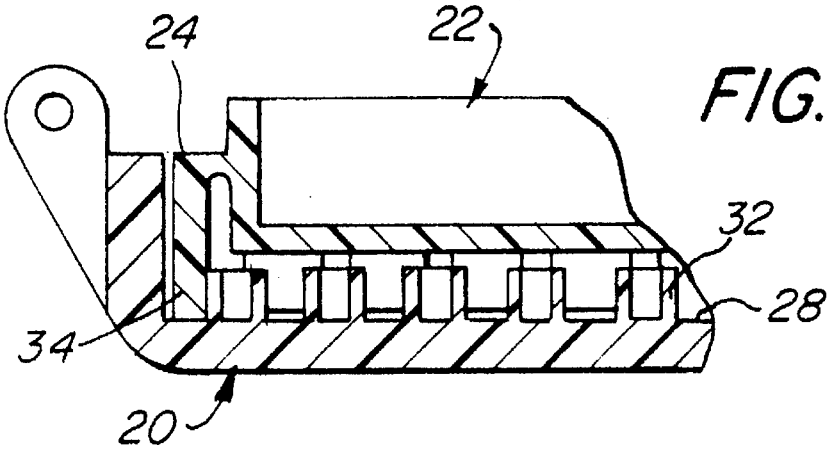
FIG. 12 is a cross-sectional view of another embodiment of a compact in accordance with the invention.
Figure 13:
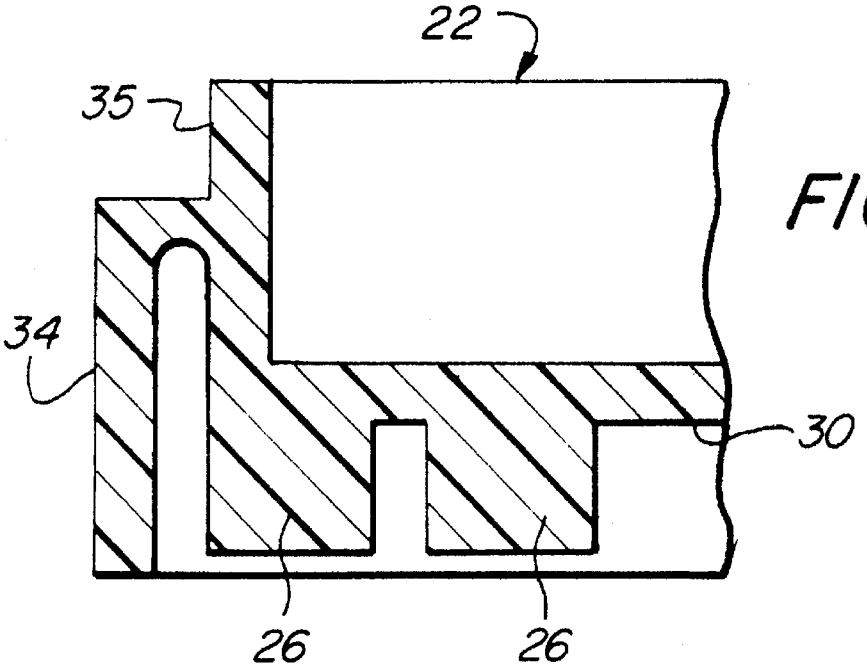
FIG. 13 is a detail cross-section view of the tray of FIG. 12.

In FIG. 12–13, the locations of the studs 26 and resilient elements 32 are reversed, i.e., the studs 26 extend downwardly from the bottom surface 30 of the tray 22, and the resilient annular elements 32 are molded in and extend upwardly from the bottom wall 28 of recess 24.

Preferably, the tray further comprises a peripheral downwardly extending skirt 34 around its outer perimeter 35. In such case, the skirt 34, and its adjacent resilient elements 32 or studs 26, interfit with and frictionally engage the resilient elements 32 or studs 26 on the base 20.

Preferably, the tray 22 further comprises a means usable by the consumer as a finger grip to remove the tray 22 from the base 20, when the tray is empty, or if the consumer desires to change to a tray having a different color cosmetic. For example, if a consumer wanted to change from colors considered appropriate for office wear to colors of cosmetics considered appropriate for evening or party wear, she could snap out one tray, and replace it with another one, or multiple trays.

One such means comprises a flange 36 extending from at least a portion of an upper edge 38 of tray 22. Other means may include a recess in the edge of the skirt 34 that can be engaged by a coin, fingernail, car key or a free end of a cosmetics applicator to pry out the tray 22 from the recess 24.

In one embodiment, as shown in FIGS. 1–5, there is one tray 22; in another embodiment, as shown in FIGS. 8–11, there are two or more such trays 22. Trays 22 can be of different sizes, for example, there can be one large and one small tray, or one larger and two smaller trays, or any other combination desirable to accommodate different cosmetics. The trays 22 may not necessarily fill the entire recess 24; for example, a front section of the recess 24 may be used to store a cosmetics applicator, and thus the tray or trays 22 would be smaller than the recess.

A cover 40 is secured by a hinge 41 to the base and is provided with a mirror 42 as is customary.

Tray 22 is molded from a plastic material having some resilience, in order to be more easily fitted into and removed from the recess 24.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A compact for a cosmetic, comprising:

a base having a recess therein, said recess having a bottom wall and a peripheral wall;

a plurality of regularly spaced apart studs extending upwardly from said bottom wall;

a removable product tray fittable into said recess, said tray having a plurality of regularly spaced apart resilient elements extending downwardly from a bottom surface of said tray;

said studs and said resilient elements being positioned relative to each other such that said product tray is fittable into said recess, and said studs and said resilient elements interfit and frictionally engage with each other to hold said tray in said recess.

2. A compact for a cosmetic in accordance with claim 1, wherein said tray further comprises a peripheral downwardly extending skirt.

3. A compact for a cosmetic in accordance with claim 2, wherein said studs interfit with and frictionally engage said skirt and said resilient elements.

4. A compact for a cosmetic in accordance with claim 1, further comprising means usable by a consumer as a finger grip to remove said tray from said base.

5. A compact for a cosmetic in accordance with claim 1, wherein there are two of said trays.

6. A compact for a cosmetic in accordance with claim 1, further comprising a cover secured by a hinge to said base.

7. A compact for a cosmetic, comprising:

a base having a recess therein, said recess having a bottom wall and a peripheral wall;

a plurality of regularly spaced apart resilient elements extending upwardly from said bottom wall;

a removable product tray fittable into said recess, said tray having a plurality of regularly spaced apart studs extending downwardly from a bottom surface of said tray;

said studs and said resilient elements being positioned relative to each other such that said product tray is fittable into said recess, and said studs and resilient elements interfit and frictionally engage with each other to hold said tray in said recess.

8. A compact for a cosmetic in accordance with claim 7, wherein said tray further comprises a peripheral downwardly extending skirt.

9. A compact for a cosmetic in accordance with claim 8, wherein said resilient elements interfit with and frictionally engage said skirt and said studs.

10. A compact for a cosmetic in accordance with claim 7, further comprising means usable by a consumer as a finger grip to remove said tray from said base.

11. A compact for a cosmetic in accordance with claim 7, wherein there are two of said trays.

12. A compact for a cosmetic in accordance with claim 7, further comprising a cover secured by a hinge to said base.

13. A compact for a cosmetic, comprising:

a base having a recess therein, said recess having a bottom wall and a peripheral wall;

a removable product tray fittable into said recess, said tray having a bottom surface;

a plurality of regularly spaced apart elements extending from one of said bottom wall of said recess and said bottom surface of said tray;

a plurality of regularly spaced apart studs extending from the other of said bottom wall of said recess and said bottom surface of said tray said studs and said elements being positioned relative to each other such that said studs and elements interfit and frictionally engage with each other to hold said tray in said recess.

14. A compact for a cosmetic in accordance with claim 13, wherein said tray further comprises a peripheral downwardly extending skirt.

15. A compact for a cosmetic in accordance with claim 14, wherein one of said elements and said studs interfit with and frictionally engage said skirt and the other of said elements and studs.

16. A compact for a cosmetic in accordance with claim 15, further comprising means usable by a consumer as a finger grip to remove said tray from said base.

17. A compact for a cosmetic in accordance with claim 16, further comprising a cover secured by a hinge to said base.

18. A compact for a cosmetic in accordance with claim 17, wherein there are two of said trays.

* * * * *